United States Patent [19]

Immel

[11] 4,223,289

[45] Sep. 16, 1980

[54] AC-DC MAGNET COIL ASSEMBLY FOR LOW DROPOUT AC CONTACTORS

[75] Inventor: Ralph B. Immel, Williamsville, N.Y.

[73] Assignee: Westinghouse Electric Corp., Pittsburgh, Pa.

[21] Appl. No.: 226

[22] Filed: Jan. 2, 1979

[51] Int. Cl.[2] ..... H01H 9/02; H01H 13/04

[52] U.S. Cl. ..... 335/202; 335/132; 361/160

[58] Field of Search ..... 335/132, 202, 191, 193, 335/250, 260; 361/160, 331

[56] References Cited

U.S. PATENT DOCUMENTS

| | | | |
|---|---|---|---|
| 3,643,194 | 2/1972 | Atherton | 361/160 |
| 3,659,237 | 4/1972 | Wilsdon et al. | 335/132 |
| 3,673,525 | 6/1972 | Collins et al. | 335/132 |

*Primary Examiner*—Harold Broome
*Attorney, Agent, or Firm*—L. P. Johns

[57] ABSTRACT

An electromagnetic contact comprising stationary and movable contacts with electromagnetic means for moving the moving contact to the closed position with the stationary contact, said means comprising a U-shaped magnetic core, an armature, and coil means for the core, the coil means comprising a pickup winding, a holding winding, and a bridge rectifier, container means comprising three portions of a uniform non-metallic insulating molded shell, one portion of which is around one leg of the U-shaped core, the other portion which is around the other leg thereof, and the third portion being adjacent to said two portions, and the pickup and holding windings being in the one and other portions of said shell respectively and the rectifier being in said third portion.

4 Claims, 10 Drawing Figures

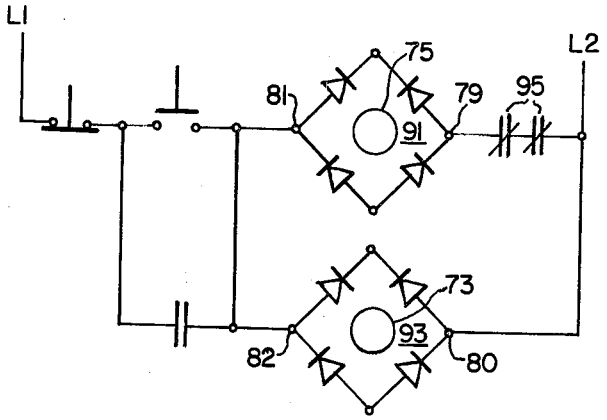
FIG.10.
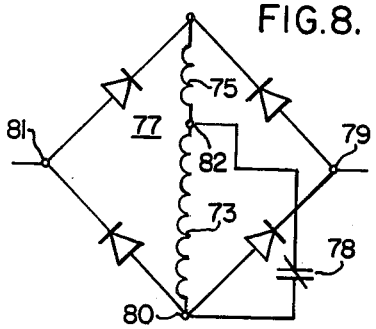
FIG.8.
FIG.9.
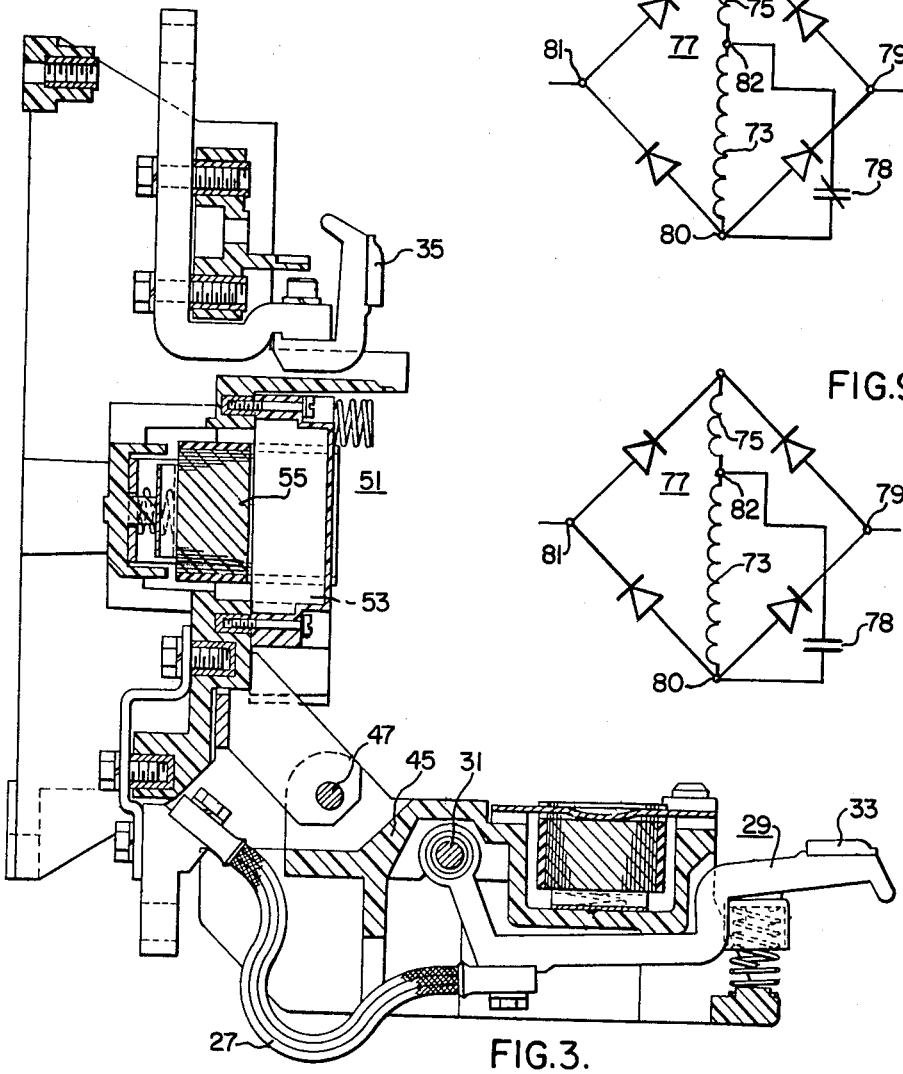
FIG.3.

AC-DC MAGNET COIL ASSEMBLY FOR LOW DROPOUT AC CONTACTORS

BACKGROUND OF THE INVENTION

1. Field of the Invention

This invention relates to electromagnetic contactors.

2. Description of the Prior Art

Conventional alternating current (AC) operating magnets are designed usually to operate over a range of 85% to 110% of the rated power system voltage. Because of the alternating current, the operating magnet field goes through zero every ½ cycle. Shading coils are required to provide some degree of field during this period. They act as short-circuited secondary windings on a transformer and also prevent chatter and reduce noise in addition to providing a holding force. AC magnets typically drop out in a range of 60 to 70% of rated operating voltage.

In the open condition, an AC magnet has a relatively high inrush current and provides a high magnetic pull-in force. The AC impedance is very low and the current is limited mainly by the direct current (DC) resistance of the operating coil. As the magnet air gap decreases, the AC impedance increases. In the magnet-sealed position, the AC impedance is relatively high and the current is reduced to a low value that will not overheat the coil. This characteristic functions as an automatic "regulator" which provides a large pull for closing in and a sufficient smaller pull to hold the magnet closed when sealed. AC magnets are generally much smaller than continuously rated DC magnets which produce the same pull-in or open-condition magnetic forces.

Many rural irrigation pumping applications are located at the end of limited power systems where voltage drops are frequent and severe. The starting of a large pump motor may cause the voltage to drop to 50% or more. This voltage dip may, in turn, cause other control equipment to shut down or malfunction. Unless an excessively large AC magnet with respect to its mechanical load tending to drop out the magnet armature is used, it is customary to use a DC magnet to secure low dropout operation.

SUMMARY OF THE INVENTION

It has been found in accordance with this invention that some problems occurring in prior art contactors may be satisfied by providing an electromagnetic contactor comprising an insulating support, a stationary contact structure on said support, a movable contact structure on said support and movable between open and closed positions relative to the stationary contact structure, support means for supporting the movable contact structure for pivotal movement between said positions, electromagnetic means comprising a magnetic armature, a magnetic core, and a coil for actuating the support means, one of said armature and said core being on the insulating support and the other being on the support means, the core being a U-shaped magnetic member, the coil comprising a pickup winding, a holding winding and a bridge rectifier, container means for the windings and rectifier and comprising a unified non-metallic insulating shell having three portions, one portion being around one leg and the other portion being around the other leg of the U-shaped member, and the third portion being adjacent to the other two portions, the pickup and holding windings being in the one and other portions of said shell respectively, the rectifier being in said third portion, and the windings and rectifier being embedded in thermosetting resin in their respective portions.

In the contactor open position, the holding winding is shorted out of the circuit by a normally closed auxiliary contact. With this arrangement, the pickup winding provides a relatively high pulling force as the DC coil current is limited only by its relatively low resistance. Even though the number of turns is relatively low, the current is very high. When the contactor is almost closed, the normally closed auxiliary contact opens and inserts the relatively high resistance holding winding into the circuit to reduce the current and to prevent overheating the coil. The relatively high turns of the holding winding along with those of the pickup winding provide sufficient magnetic force to hold the contactor closed down to a relatively low input voltage.

The combination of the pickup winding, the holding winding, bridge rectifier, and normally closed auxiliary contact function to provide an operating magnet operation analogous to the AC operation as set forth above.

The advantage of the device of this invention is that a more economical coil assembly is provided with reduced size, as well as a reduction in the number of parts required. Moreover, the device has the advantage of an AC input that provides DC operation characteristics for a low dropout of 25% to 30% rated voltage.

BRIEF DESCRIPTION OF THE DRAWINGS

FIG. 3 is a sectional view similar to FIG. 2 with the arc-hood structure removed and with the movable structure in the maintenance position;

FIG. 8 is a circuit diagram showing the contactor in the open position;

FIG. 9 is a circuit diagram showing the contactor in the closed position; and FIG. 10 is a circuit diagram of a rectifier bridge of another embodiment.

DESCRIPTION OF THE PREFERRED EMBODIMENTS

Figure 1:
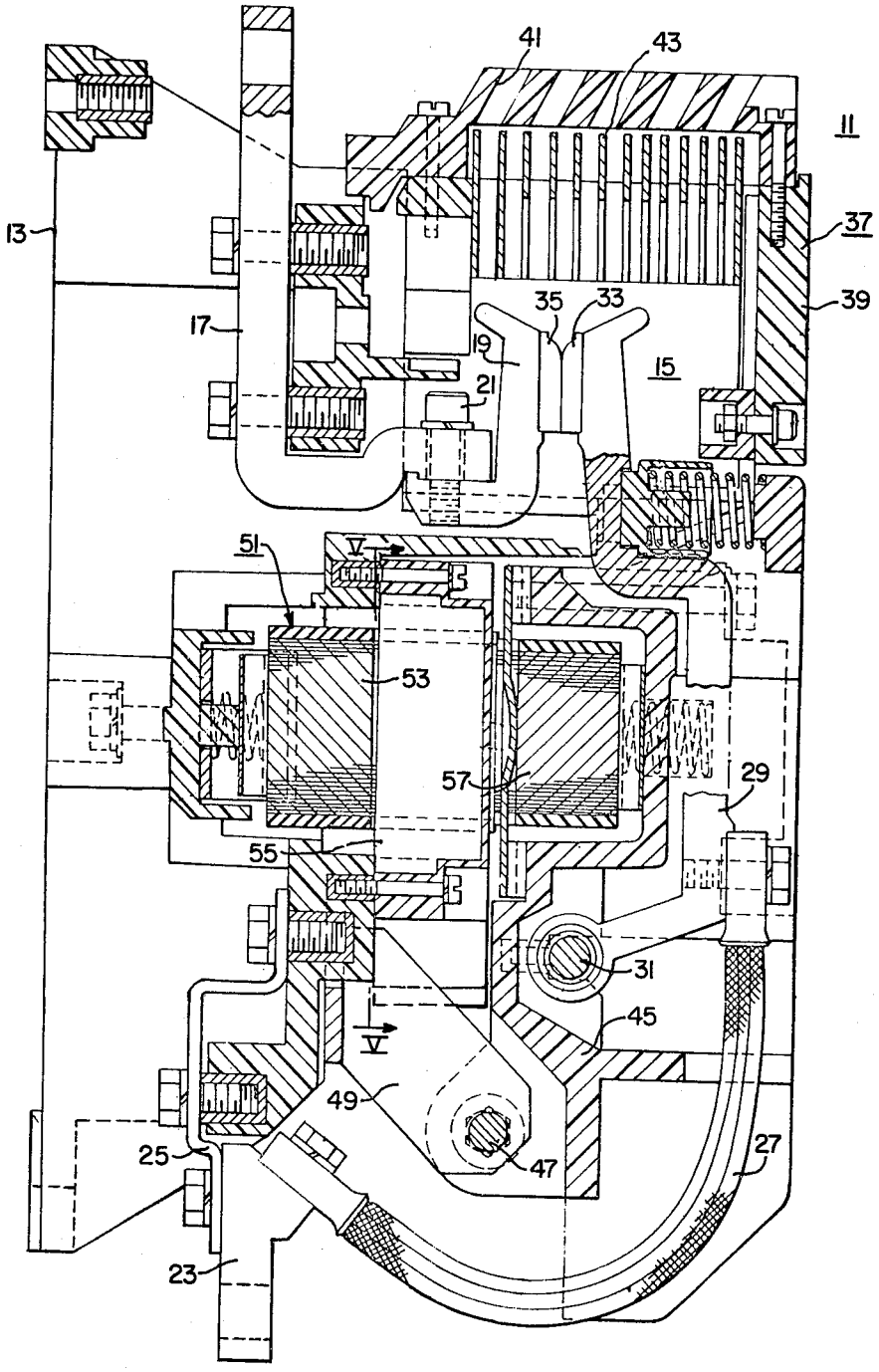
FIG. 1 is a vertical sectional view of a contactor constructed in accordance with this invention and shown in the closed position.

Inasmuch as the disclosed contactor is similar in construction and operation to that disclosed in U.S. Pat. Nos. 3,659,237 and 3,673,525, the description is limited herein to the basic structure and operation.

In the drawings a three-pole contactor is generally indicated as 11 and it comprises a stationary insulating support 13 and a contact structure generally indicated at 15 on the support. In each pole unit, there is a conductor 17 with a stationary contact 19 secured thereon, and a conductor is mounted on the support 13 by means of a bolt 21. For each pole unit, there is a terminal conductor 23 supported on a support plate 25 that is, in turn, secured to the insulating support 13. The terminal conductor is conducted by a flexible conductor 27 to a contact arm 29 which is pivotally mounted on the pivot pin 31. A movable contact 33 is mounted on the upper end of the contact arm 29 and the movable contact cooperates with a stationary contact 35.

An arc-hood structure 37 is removably mounted on the support 13 and comprises molded insulating members 39, 41. A plurality of slotted magnetic plates 43 are mounted within the arc-hood structure 37.

A molded insulating carrier 45 is pivotally mounted at 47 between a pair of spaced support members 49. The contact arm 29, in turn, is pivotally mounted on the carrier 45 to enable usual movement of the contact arm between the closed and opened positions of FIGS. 1 and 2 respectively. In addition, for maintenance the carrier 45 may be moved to the maintenance position (FIG. 3).

Figure 2:
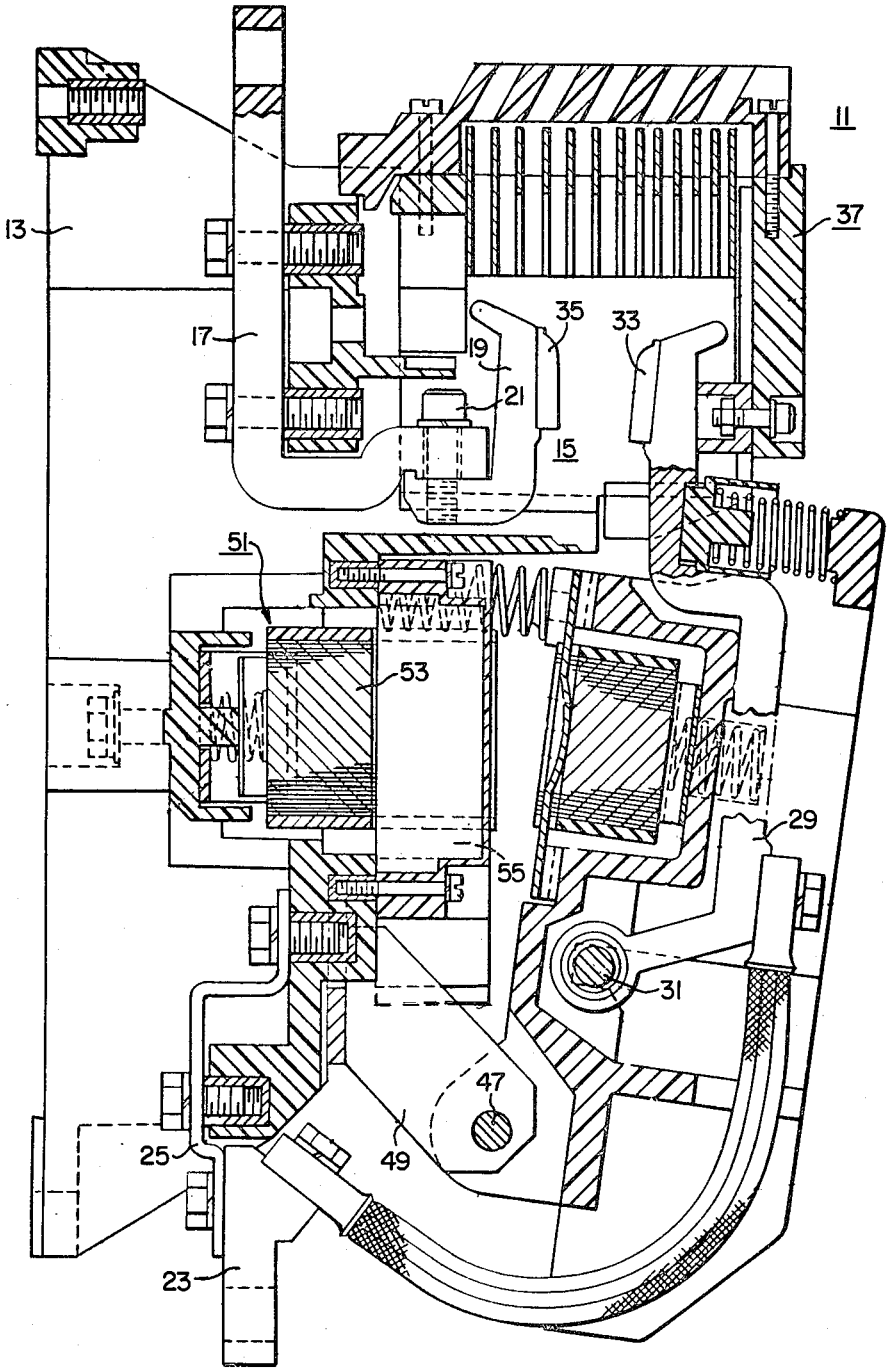
FIG. 2 is a view similar to FIG. 1 shown in the open position.

The contactor 11 comprises electromagnetic means generally indicated at 51 and includes a single generally U-shaped magnetic member or yoke 53, coil means 55, and a generally U-shaped armature 57. The magnetic member or yoke 53 and coil means 55 are suitably mounted on the support 13. The armature 57 is mounted on the carrier 45 as shown in FIGS. 1 and 2. However, the positions of the armature 57 and the yoke 53 may be reversed without affecting operation of the contactor. Accordingly, when the electromagnetic means 51 is actuated, the contacts 33, 35 are in the closed position of FIG. 1, and in the open position (FIG. 2) upon deactivation of the electromagnetic means.

Figure 4:
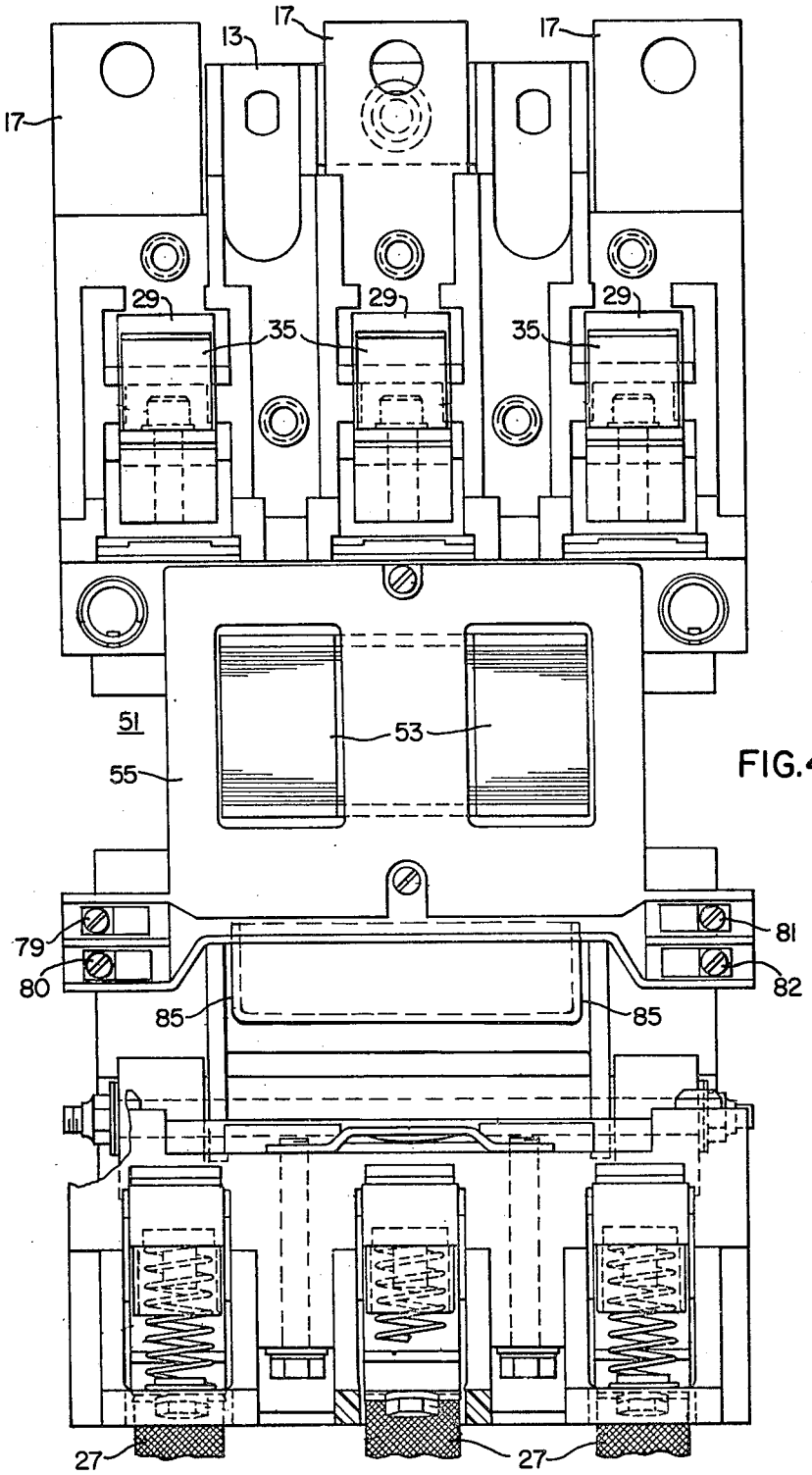
FIG. 4 is a plan view of the contactor in the maintenance position of FIG. 3.

As shown more particularly in FIGS. 4–7 the electromagnetic means 51 also comprises a molded shell 59 of dielectric insulating material, such as a thermosetting mineral-filled epoxy or glass reinforced polyester resin. The shell includes a peripheral wall 61 and a pair of inner walls 63, 65, and a divider wall 67. The inner walls 63, 65 form separate openings through which the two portions of the magnetic member or yoke 53 extend (FIG. 4). The inner walls 63, 65 also form with the walls 61, 67 a pair of troughs 69, 71 which are separated from each other by divider wall 67. The molded shell 59 contains the coil means 55 which comprises a holding coil 73 and a pickup coil 75. The trough 69 contains the holding coil 73 and the trough 71 contains the pickup coil 75. The coil means 55 also includes a rectifier 77 which is interconnected with the coils 73, 75 by suitable conductor wires. In addition, conductor wire terminals 79, 80, 81, 82 are provided in a conventional manner. The circuits of FIGS. 8 and 9 show the contactor in the open and closed positions with a normally closed auxiliary contact 78 between the terminals 80 and 82.

Figure 6:
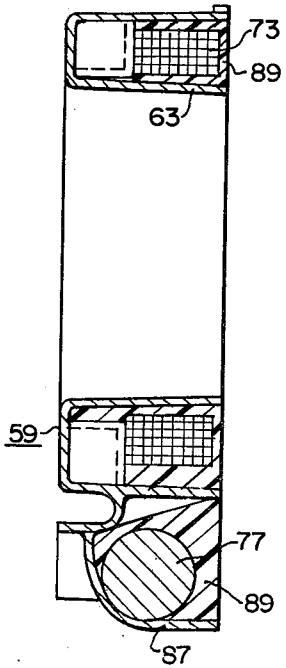
FIG. 6 is a vertical sectional view taken on the line VI—VI of FIG. 5.
Figure 7:
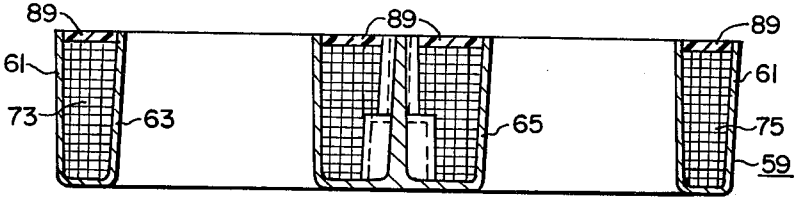
FIG. 7 is a sectional view taken on the lines VII—VII of FIG. 5.
Figure 5:
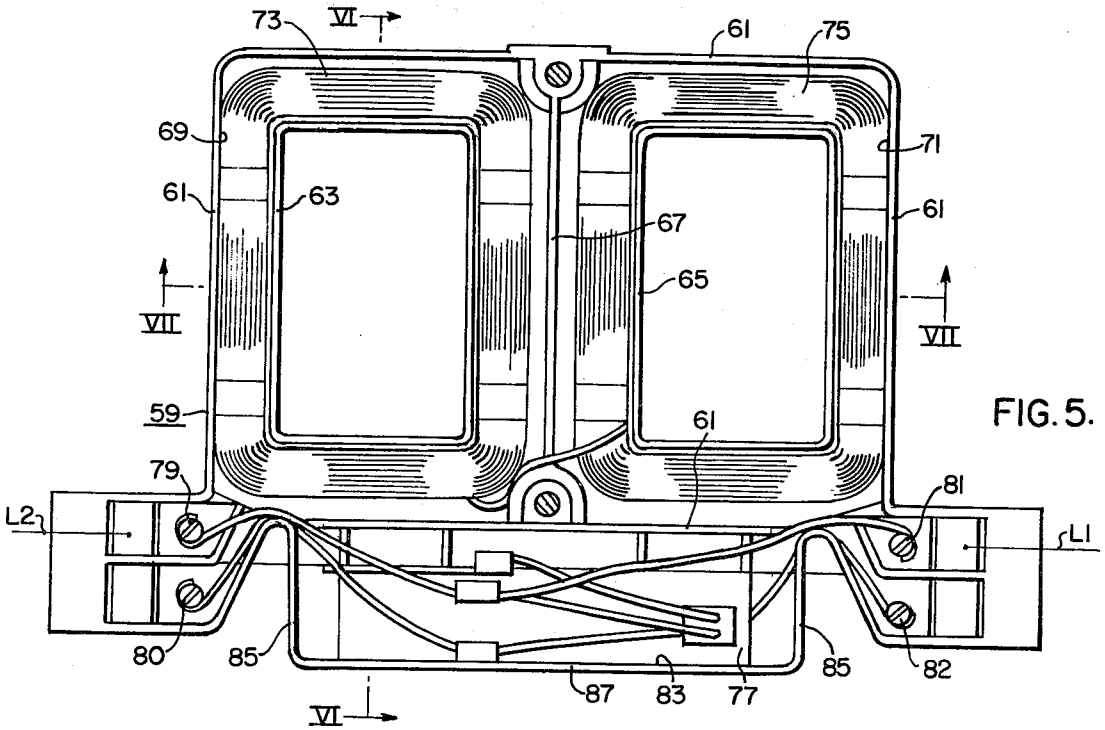
FIG. 5 is a vertical plan view of a molded shell for containing holding windings, pickup windings, and a rectifier in accordance with this invention, taken on the line V—V of FIG. 1.

In accordance with this invention the molded shell 59 also comprises a trough 83 provided by walls 85, 87 which are an integral part of and extend from the wall 61 (FIGS. 5, 6). Thus, the rectifier 77 is proximate to the coils 73, 75 and because of this proximity enables the elimination of other conductors as well as a resistor. A primary advantage is that after the coils 73, 75 and the rectifier 77 are inserted in place as shown in FIG. 5, they are subsequently encapsulated or embedded in a layer 89 (FIG. 7) of a suitable dielectric and insulating material such as mineral-filled polyester resin.

An AC input coil assembly is also provided which has an internal pickup winding, a holding winding, and a bridge rectifier that provides DC operation characteristics for a low dropout of 25% to 30% rated voltage. For example, the pickup coil 75 is constructed with a pickup winding of 700 turns of No. 25 wire that has a resistance of approximately 16.9 ohms. The holding coil 73 is comprised of 4,000 turns of No. 33 wire that has a resistance of approximately 613 ohms. The rectifier 77 is a 250-volt silicon avalanche diode bridge unit. With that assembly the contactor 11 picks up and seals on 67 volts (55% on a 120 V rating) and drops out at 21 volts (18% on a 120 V rating). At 120 volts it dissipates 15 watts in the closed (armature sealed) position. Such a performance meets all low dropout application requirements.

The pickup and holding coils 73, 75 are separate continuous windings which allow considerable leeway in the design combinations. For example, if more heat dissipating surface is required, one-half the holding winding can be wound on one-half the pickup winding to distribute the heat over twice the surface area. However, that combination is more expensive because it requires essentially four windings and additional connections. Moreover, with the coil design disclosed in FIG. 5 the contactor 11 operates on AC (any frequency) or DC input. An additional advantage is that AC magnet shading coils are eliminated. Furthermore, with DC operation, the laminated iron construction may be replaced with thick iron laminations or solid magnet iron. Also, the expensive ground magnet face surfaces are not required.

Associated with the foregoing is a circuit 89 of another embodiment for using normally closed contacts in an AC circuit. (Similar reference numbers are used where possible.) Separate and individual silicon diode bridges 91 and 93 are used with the coils 75 and 73. The bridges are identical except for the ratings, the pick-up coil bridge rectifier 91 having a 3 ampere rating and the holding bridge rectifier 93 having only a 0.2 ampere rating. While this embodiment requires another rectifier bridge, it has an advantage in that a normally closed auxiliary contact 95 is in the AC circuit. Arc interruption in an AC circuit is easier than in a DC circuit with small contact gaps.

What is claimed is:

1. An electromagnetic contactor comprising an insulating support, a stationary contact structure on said support, a movable contact structure on said support and movable between open and closed positions relative to the stationary contact structure, support means for supporting the movable contact structure for pivotal movement between said positions, electromagnetic means comprising a magnetic armature, a magnetic core, and a coil for actuating the support means, one of said armature and said core being on the insulating support and the other being on the support means, the core being a U-shaped magnetic member, the coil comprising a pickup winding, a holding winding and a bridge rectifier, container means for the windings and rectifier and comprising a non-metallic molded insulating shell having two portions with one portion around one leg and the other portion around the other leg of the U-shaped member, the molded shell also having a third portion adjacent to said two portions, the pickup and holding windings being in the one and other portions of said shell respectively, and the rectifier being in said third portion.

2. The contactor of claims 1 in which the three portions of the container means comprise a unified member.

3. The contactor of claim 2 in which the shell is comprised of molded mineral-filled epoxy or glass reinforced polyester resin.

4. The contactor of claim 3 in which a thermosetting mineral-filled polyester resin embeds the windings and rectifier in their respective portions.

* * * * *